United States Patent [19]

Hellberg et al.

[11] 4,176,644

[45] Dec. 4, 1979

[54] ENGINE IGNITION SYSTEM WITH VARIABLE SPARK INTERNAL DURATION

[75] Inventors: Rainer Hellberg, Straberg-Dormagen; Leo Steinke, Hegnach; Adolf Fritz, Stuttgart, all of Fed. Rep. of Germany

[73] Assignee: Robert Bosch GmbH, Stuttgart, Fed. Rep. of Germany

[21] Appl. No.: 845,610

[22] Filed: Oct. 26, 1977

[30] Foreign Application Priority Data

Oct. 27, 1976 [DE] Fed. Rep. of Germany ..... 2648531

[51] Int. Cl.[2] ..... F02P 3/04; F02P 5/00

[52] U.S. Cl. ..... 123/148 E; 123/117 R

[58] Field of Search ..... 123/148 E, 146.5 A, 123/117 R; 315/209 T; 361/256, 263

[56] References Cited

U.S. PATENT DOCUMENTS

| | | | |
|---|---|---|---|
| 3,559,629 | 2/1971 | Sauvignet | 123/148 E |
| 3,587,552 | 6/1971 | Varaut | 123/148 E |
| 3,605,713 | 9/1971 | Masters et al. | 315/209 T |
| 3,841,288 | 10/1974 | Korteling | 315/209 T |
| 3,881,458 | 5/1975 | Roozenbeek et al. | 123/148 E |
| 3,890,944 | 6/1975 | Werner et al. | 123/148 E |
| 4,051,827 | 10/1977 | Capurka et al. | 315/209 T |

*Primary Examiner*—Charles J. Myhre
*Assistant Examiner*—P. S. Lall
*Attorney, Agent, or Firm*—Frishauf, Holtz, Goodman & Woodward

[57] ABSTRACT

An RC circuit branch determines the duration of the period for which the primary circuit of a spark coil remains interrupted after the main peak of the spark discharge in the secondary circuit that includes a spark plug. Engine speed and engine temperature are used to shorten the period during which the secondary circuit is allowed to entertain a spark discharge. As engine speed increases the spark discharge period is reduced until a certain speed is reached after which the spark discharge period remains constant with further increase of engine speed. Engine temperature is also used to shorten the spark discharge period by the use of a temperature sensitive resistor. The charging and discharging of the storage capacitor of the RC circuit branch are separately controlled by the shunt circuits in which diodes are interposed and in one embodiment an additional capacitor can be switched into parallel into the RC circuit branch when the engine is starting up. The degree of intake manifold vacuum can also be used to modify the operation of the circuit.

16 Claims, 5 Drawing Figures

ENGINE IGNITION SYSTEM WITH VARIABLE SPARK INTERNAL DURATION

This invention concerns an ignition system for more reliably igniting electrically the compressed fuel and air mixture in the cyclinder or cyclinders of an internal combustion engine. In particular, the invention concerns an ignition system having a final stage transistor of which the emitter-collector path is, during operation of the engine, connected in series with the primary winding of an engine ignition spark coil and electric dc source such as a motor vehicle battery. Blocking of the current during the final stage transistor produces an ignition spark in a spark plug in the engine, the spark consisting of a main discharge immediately followed by what may be called a discharge tail. The duration of the blocking of the emitter-collector path of the final stage transistor is determined by the characteristic of an RC circuit branch of the ignition system.

An ignition system of the type just described is known from German published and examined patent application (AS) 1 099 268, in which the RC circuit branch is so constituted and connected that the duration of the nonconducting period of the final stage transistor remains unchanged during the operation of the engine. This has the disadvantage that at low speed of the engine more energy is stored in the spark coil than is necessary for an effective ignition spark, so that the spark coil is unnecessarily loaded, and that at high speed there is not enough time to store the necessary amount of energy for a fully effective ignition spark.

THE PRESENT INVENTION

It is an object of the present invention to provide an ignition system in which energy is not wasted and the spark plugs are not unnecessarily worn out at low engines speeds and, furthermore, a system in which the current in the spark coil primary winding is interrupted for a sufficient time at high engine speed to allow the generation of a fully effective spark.

Briefly, the flow of current in at least one direction between the remainder of the system and the RC circuit branch that times the duration of the nonconduction period of the final stage transistor that interrupts the primary circuit of the spark coil, is variable automatically in response to at least one operating parameter of the engine in such a manner that under certain operating conditions of the engine the duration of the period of nonconduction of the final stage transistor is terminated before the discharge tail following the main spark discharge has subsided. More particularly, with increasing engine speed the duration of the nonconduction period of the final stage transistor is progressively shortened, preferably just up to a certain speed, after which the duration remains constant as speed increases further. Furthermore, it is also preferred for the duration of the nonconduction period of the final transistor to be shortened with increasing engine temperature. On the other hand, in the engine start-up process, it is desirable for the duration of the nonconduction period of the final stage transistor to be sufficient to allow the discharge tail to die away before the nonconduction period ends.

The particular circuits by which the RC circuit branch is made variable in response to at least one engine parameter are defined in certain claims the subject matter of which will be better understood after the detailed description of illustrative examples of the invention shall have been explained.

The arrangements of the invention have the advantage that the wear of the spark plug is greatly reduced without sacrifice of high-speed performance of the engine ignition system.

Drawing, illustrating examples:

Figure 1:
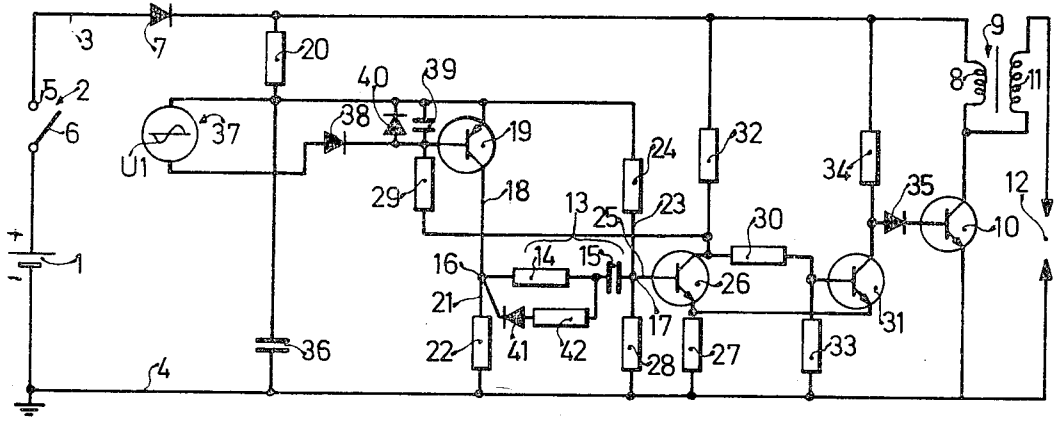
FIG. 1 is a circuit diagram of ignition system according to the invention.

The engine ignition system illustrated by the circuit diagram of FIG. 1 is designed for the engine of a motor vehicle. It is supplied with electrical power from a dc source 1 which can for example be the usual storage battery of a motor vehicle. From the positive pole of the dc source 1 a connection goes through an operating switch to, usually referred to as the ignition switch of a vehicle engine, to a supply voltage terminal 3. Likewise from the negative pole of the battery a connection goes to a second voltage supply terminal that is grounded to the vehicle chassis. The on-off switch 2 has a fixed contact 5 and a movable contact 6. The first power supply terminal 3 is connected through a diode 7 that provides protection against improper connection of the current source 1. The diode 7 is normally energized in its conducting direction by the dc source during operation of the system. The connection from the power supply terminal 3 through the diode 7 continues through the primary winding 8 of an ignition coil 9 to the collector of an npn transistor 10 of the final stage of the control circuit, the emitter of this transistor being connected to the second power supply terminal 4 (chassis ground). The secondary winding 11 of the spark coil 9 acts on at least one spark plug 12 that has its other electrode connected to the second supply terminal 4 (chassis ground). Of course the secondary winding 11 can also, in a manner already in itself known, be connected for operation in succession with a number of spark plugs of a multicyclinder engine by means of an ignition distributor.

The duration of the period during which the emitter-collector path of the final stage transistor 10, that is normally conducting during engine operation, is caused to be nonconducting is dependent upon the effect of an RC circuit branch 13. In the present case, the current flowing to or from the RC circuit branch 13 is so modified in response to at least one operation parameter of the engine, that in certain operating conditions of the engine the duration of nonconduction of the final stage transistor 10 is terminated before the discharge tail that follows the discharge peak of an ignition spark has died away. The RC circuit branch 13 consists of the series connected combination of a charging resistor 14 and a storage capacitor 15, this series combination constitutes the RC circuit branch 13 having on the resistor side of the circuit branch a first terminal 16 and on the capacitor side of the circuit branch the second terminal 17.

The first terminal 16 of the RC circuit branch 13 is the point from which there branches out a second circuit branch 18 that leads through the emitter-collector path of a first control transistor 19 and then continues through a resistance 20 to the first electric supply terminal 3 and in practice to the common connection of the terminal 3 and the cathode of the diode 7. The control transistor 19 is of a pnp type. The first terminal 16 of the RC circuit branch 13 is also the place from which a third circuit branch 21 branches off that leads through a resistance 22 to the second power supply terminal 4 (chassis ground in this example). The second terminal 17 of the RC circuit branch 13 is the place of beginning of a fourth circuit branch 23 that leads through a resistance 24 and thereafter through the resistance 20 to the first power supply terminal 3. The second terminal 17 of the RC circuit branch 13 is also the place of branching out of a fifth circuit branch 25 that leads through the base-emitter path of a second control transistor 26 that is of the npn type and then continues through a resistance 27 to the second power supply terminal 4 (chassis ground in this example). The base of the second control transistor 26 is also connected through a resistance 28 to the second power supply terminal 4 (chassis ground in this example). The collector of the second control transistor 26 is connected through a feedback resistor 29 to the base of the first control transistor 19 and also through a resistance 30 to the base of another control transistor 31 of the npn type and through a resistance 32 to the first power supply connection 3 and more particularly to the portion of this connection 3 that is on the cathode side of the diode 7.

The third control transistor 31 that has its emitter connected to the emitter of the second control transistor 26 and its base connected through a resistance 33 to the second (grounded) power supply connection 4, has its collector connected through a resistance 34 to the portion of the power supply connection 3 that is connected to the cathode of the diode 7. A diode 35 has its cathode connected to the base of the final stage transistor 10 and its anode connected to the collector of the third control transistor 1.

The end of the resistance 20 away from the power supply connection 3 is connected to the emitter of the first control transistor 19 and also, through a capacitor 36 with the second (grounded) power supply connection 4 and finally, also connected through a signal transmitter or generator 37 with the anode of a diode 38, of which the cathode is connected to the base of the first control transistor 19. In shunt to the base-emitter path of the first control transistor 19 there is connected the parallel combination of a capacitor 39 and a diode 40, with the cathode of this diode 40 is connected to the emitter of the first control transistor 19. The signal transmitter 37 just mentioned should operate as a sort of alternating current generator, in other words, it should operate in a contactless manner to provide periodically the first half wave U 1 of its alternating current period, made available at its output for the purpose of setting off the ignition event. Finally, it is to be recommended to provide a bridging diode 41 in shunt with the charging resistor 14, the cathode of this bridging diode 41 being connected to the terminal 16 of the RC circuit branch 13. The current flowing through this bridging diode 41 can be limited by means of a bridging circuit resistor 42 connected in series to the diode 41.

OPERATION OF THE ABOVE DESCRIBED CIRCUIT

As soon as the ignition switch 2 is closed, the ignition system is ready to operate. During operation, the emitter-collector path of the first control transistor 19, the emitter-collector path of the second control transistor 26 and the emitter-collector path of the final stage transistor 10 are all normally conducting, whereas, in contrast, the emitter-collector path of the third control transistor 31 is in the nonconducting condition. In consequence, current flows freely through the primary winding 8 and energy is stored in the spark coil 9 for the forthcoming ignition event. The storage capacitor 15 is charged to the conducting emitter-collector path of the first control transistor 19 and this occurs through the ignition switch 2, the diode 7, the resistor 20, the emitter-collector path of the first control transistor 19, the charging resistor 14 and the resistance 28, so that the storage capacitor 15 becomes positive at its electrode nearer the terminal 16 of the RC circuit branch 13. The flow of current to the storage capacitor 15 controlled by by the time constant of the RC circuit branch 13 is so chosen that, at least during the starting up of the engine, the storage capacitor 15 is at least approximately fully charged. If now the half wave U 1 is provided to the circuit by the signal generator 37 that is driven by the engine, so that a flow of current through the diodes 38, 40 is produced, then the emitter-collector path of the first control transistor 19 is put into the nonconducting condition as a result of the fall of voltage at the diode 40. Accordingly, the storage capacitor 15 begins to discharge, the discharge takes place through the ignition switch 2, the diode 7, the resistor 20, the resistor 24, the bridging resistor 42, the bridging diode 41 and the resistor 22, in this case the current through the charging resistor 14 being negligible. In this discharging process the base of the second control transistor 26 is made momentarily negative compared to the emitter of that transistor so that the emitter-collector path of this transistor 26 is put into the nonconducting condition. This has the result that the emitter-collector path of the third control transistor 31 becomes conducting and in response thereto the emitter-collector path of the final stage transistor 10 is made nonconducting.

When that happens the current flowing through the primary winding 8 is interrupted and in the secondary winding 11 an ignition voltage pulse is produced that causes an ignition spark to jump across the terminal of the spark plug 12.

Figure 2:
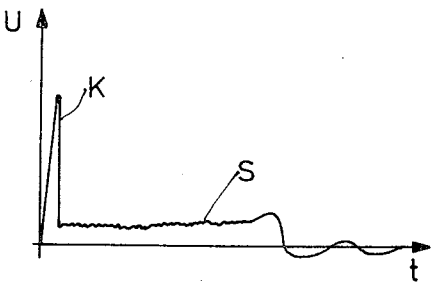
FIG. 2 is a graph of the voltage of a spark discharge plotted against time.

FIG. 2 illustrates the course with time of the effective voltage U at the spark plug 12 during the duration of the ignition discharge. The needle-like voltage peak visible in FIG. 2 in the beginning of the curve is the peak or head of the main discharge K of the ignition spark that initiates the electrical discharge at the spark plug 12. After the spark peak K, as a result of after discharges occurring at substantially lower voltages in comparison to the spark peak K and lasting for a considerably longer time then the spark peak K, discharges are still maintained that are called the discharge tail of the ignition spark, illustrated by the section S following the discharge peak portion K illustrated in FIG. 2. The discharge tail S finally dies away as a damped oscillation. In point of time the ignition spark takes up approximately 30 $\mu$s for the main discharge peak K and about 2 ms for the discharge tail S. It is assumed that the spark event just described has taken place during start-up of the vehicle engine, so that only after the dying away of the discharge tail S has the capacitor 15 discharged far enough to be able to provide a positive base electrode bias for the second control transistor 26 in order to put the emitter-collector path of this transistor 26 into the conducting condition. If the emitter-collector path of the second control transistor 26 becomes conducting again, the emitter-collector path of the third control transistor 31 goes into the nonconducting condition and, in response in turn thereto, the emitter-collector path of the final stage transistor 10 goes over into the conducting condition, so that current again flows through the primary winding 8 and energy is built up anew in the ignition coil 9 for a forthcoming spark. As soon as the emitter-collector path of the first control transistor 19 also goes back into the conducting condition, a new charging up of the storage capacitor 15 begins in the manner that has already been described.

With increasing rate of rotation of the engine, the time period during which the storage capacitor 15 is charged becomes shorter so that the value at which its discharge begins, diminishes. That has the result that the time period during which the second control transistor 26 has its emitter-collector path blocked and likewise also the final stage transistor 10, diminishes with increasing engine speed and this goes on so far that the ignition spark is no longer effective until the dying away of its discharge tail S, but only for a duration of a few hundred μs. Under these conditions, it may be said that the spark is effective with a shortened discharge tail S. In the case just described, the shortening of the ignition spark event is depended upon the engine operating parameter "speed" (r.p.m.).

By the use of the bridging diode 41 often suitably combined in series connection with the relatively low-resistance bridging circuit resistance 42 the charging circuit is made as far as possible independent of the discharge circuit for the storage capacitor 15 so that the provision of the network of this branch of the circuit is relatively simply constituted. The capacitor 36, cooperating with the resistance 20, protects the ignition system from disturbance pulses. By means of the diode 38 and 40 it is made possible to make effective at the base-emitter path of the first control transistor 19 only those half waves of the ac period made available by the signal generator 37 that are actually necessary for control of the system. The capacitor 39 keeps disturbance pulses away from the base-emitter path of the first control transistor 19. The switching of the emitter-collector path of the first control transistor 19 and the emitter-collector path of the second control transistor 26 is accelerated by the provision of the feedback resistor 29. The second control transistor 26 forms with the third control transistor 31 and the resistances of 27, 30, 32 and 33 a threshold switch circuit of the Schmitt trigger sort. The diode 35 serves to raise the switching threshold of the final stage transistor 10.

Figure 3:
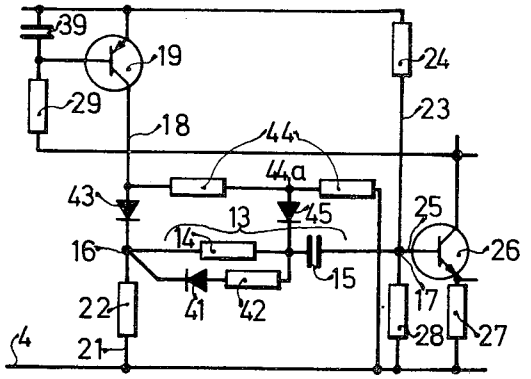
FIGS. 3, 4 and 5 are circuit diagrams of other embodiments of the invention differing in certain respects from the circuit of FIG. 1.

FIG. 3 shows a section of the circuit of FIG. 1 in the neighborhood of the RC circuit branch 13. In FIG. 3 circuit components that correspond in terms of function and circuit position with the circuit components in FIG. 1 have the same reference numerals as in FIG. 1. In FIG. 3 the RC circuit branch 13 is completed by a network that has a diode 43 interposed in the second circuit branch 18, with its cathode connected to the first terminal 16 of the RC circuit branch 13 and its anode connected through a voltage divider 44 to the second power supply terminal 4. The tap 44*a* of this voltage divider 44 is connected to still another diode 45 that has its cathode connected to the electrode of the storage capacitor 15 that is towards the circuit terminal 16 in the RC circuit branch 13.

In terms of operation, the provision illustrated in FIG. 3 result in that the storage capacitor 15 is charged relatively quickly to a particular value over the resistance portion of the voltage divider 44 adjoining the first control transistor 19 and over the diode 45, after which, further charging takes place only slowly over the diode 43 and the charging resistor 14, which is easily provided by corresponding choice of the time constants. The result is thereby obtained that, with increase of the speed of the engine up to a certain speed value, the discharge tail S is progressively shortened and thereafter the discharge tail has a constant duration with further increase of speed. An ignition system in which this feature is used is suitable both for a 4 cyclinder engine and also for an 8 cyclinder engine, because over the entire speed range of the engine the ignition spark always stretches over the time period required for effective ignition of the fuel-air mixture in the engine.

Figure 4:
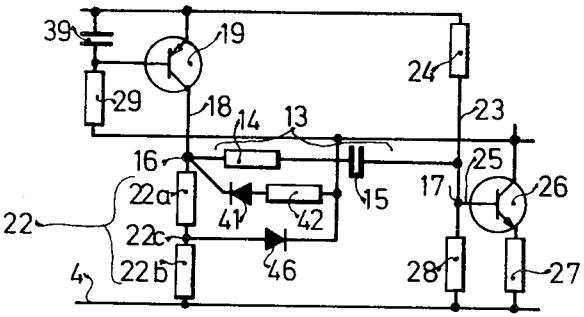

In FIG. 4 a feature is shown that is similar to the one just described in connection with FIG. 3. In the circuit in FIG. 4, however, the voltage divider 44 and the diode 43 of FIG. 3 are dispensed with and instead thereof the resistor 22 provided in the third circuit branch 21 is subdivided into two resistor portions 22*a* and 22*b*, with their common connection 22*c* connected to the anode of a diode 46, of which the cathode is connected to the electrode of the storage capacitor 15 that is the farther away from the second terminal 17 of the RC circuit branch 13. In this case a certain interconnection of the charging and discharging circuits of the storage capacitor 15 must be accepted as the price of the simplification, but the circuit of FIG. 4, in comparison to that of FIG. 3 saves circuit components and satisfactorily enough obtains the same effect as that explained in reference to FIG. 3.

Figure 5:
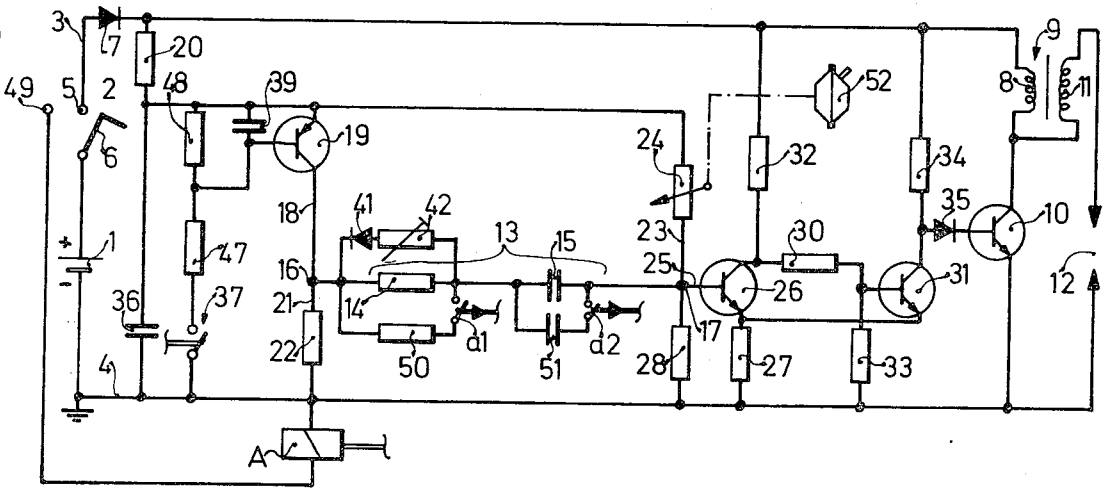

The ignition system of FIG. 5 is distinquished from that of FIG. 1 in that the signal generator 37 is a conventional interrupter switch that is opened at the ignition timing moment by a cam (not shown in the drawing) that is rotably driven by the engine. The interrupter switch fulfilling the function of the signal transmitter 37 is connected between the second power supply terminal 4 and one terminal of a resistance 47, the other terminal of which is connected to the base of the first controlled transistor 19. In addition, the base-emitter path of the first control transistor 15 is shunted by a resistor 48. The ignition system according to FIG. 5 is distinquished further from that of FIG. 1 in that the ignition switch 2 is provided with a further fixed start contact 49, so that upon starting of the engine the movable contact arm 6 comes into contact with both fixed contacts 5 and 49. A conductor leads from a fixed contact 49 to the winding of a relay A and again from that relay winding to the second power supply terminal 4. By means of the relay A a first contact a 1 operating as a circuit closer and/or a second contact a 2 operating as a circuit closer are both operable. The contact a 1 forms with a resistor 50 a series branch circuit in shunt to the charging resistor 14. The contact a 2 forms with a capacitor 51 a series circuit combination in shunt with the storage capacitor 15. Finally, the ignition system illustrated in FIG. 5 differs from that in FIG. 1 also in that the bridging resistor 42 is a hot conduction resistor and is subject to control by the resistance 24 in the fourth circuit branch in response to the pressure (vacuum) in the intake manifold of the engine, and this by means of a pressure (aneroid) chamber 52. In this case the feedback resistance 29 is omitted.

The ignition system illustrated in FIG. 5 has, in comparison with that of FIG. 1 a further improved operation in several respects. In starting the engine, the movable contact arm of the ignition switch 2 makes contact also to the fixed contact 49, so that the relay a operates, which has the result of closing the contact a 1 and/or the contact a 2. The resistor 50 is thereby connected in parallel with the charging resistor 14 and/or the capacitor 51 is connected in parallel with the storage capacitor 15. By utilization of one of these expedients, or both of them, it can be assured that during the discharge phase of the operation, the emitter-collector path of the second control transistor 26 and thereby also the emitter-collector path of the final stage transistor 10 will certainly be held in its nonconducting condition for a sufficient duration to allow a complete ignition spark to develop in every case, which is particularly important for the ignition of the fuel-air mixture when the engine is in a very cold condition. Furthermore, because the bridging circuit resistor 42 is a hot conduction resistor, the discharge of the storage capacitor 15 at higher temperatures of the engine proceeds faster, so that a shortening of the ignition spark event takes place likewise with increasing temperature. Finally, by the control of the resistance 24 in response to the pressure in the intake manifold of the engine, the result can be produced that in operation under very low partial load of the engine, the spark duration will be only slightly shortened, or not at all. This precaution can be carried out by reducing the value of the resistance 24 in very low load operation of the engine, so that the discharge of the storage capacitor 15 proceeds very slowly and the emitter-collector path of the second control transistor 26 as well as the emitter-collector path of the final stage transistor 10 remain nonconducting for the time period necessary toward the development of a complete ignition spark.

Although the invention has been described with reference to particular specific embodiments, modifications and variations are possible within the inventive concept and, in particular, features of some embodiments can generally be adapted to other embodiments in various ways.

We claim:

1. An engine ignition system including a final stage transistor having its emitter-collector path (10) connected, during engine operation, in series with a dc source and the primary winding of an ignition spark coil and arranged to be recurrently made nonconducting for periods long enough to produce, at a spark plug in the secondary circuit of said spark coil, a main spark discharge and an immediately following discharge tail, and including also an RC circuit branch (13) by which the duration of the period of nonconduction of said path of said transistor is determined, said system incorporating also the improvement consisting in that:

a bridging diode (41) is provided in a shunt around said resistor (14) of said RC circuit branch (13), said bridging diode being so poled that it is conducting during the discharge of said storage capacitor (15), and said RC circuit branch (13) consists of the series combination of a charging resistor (14), and a storage capacitor (15) so connected that the said nonconducting period of said path of said transistor ends with the charging of said storage capacitor (15) and begins with the discharging of said storage capacitor (15);

the flow of current in at least one direction between the remainder of the system and said RC circuit branch, and thereby the rate of charging and/or discharging of said capacitor (15), is variable automatically in response to at least one operating parameter of the engine in such a manner that under certain operating conditions of the engine the duration of said period of nonconduction is terminated before the discharge tail (S) following a main spark discharge (A) has subsided.

2. An engine ignition system as defined in claim 1 in which said bridging diode (41) is in a series with a bridging circuit resistor (42) interposed in circuits so that the series combination of said bridging diode (41) and said bridging circuit resistor (42) is in shunt with said resistor (14) of said RC circuit branch (13).

3. An engine ignition system as defined in claim 1 in which said RC circuit branch is variable automatically in response to at least one operating parameter of the engine in such a manner that with increasing speed of the engine the portion of said discharge tail (S) following a main spark discharge (K) that occurs before the termination of the non-conducting period of said final stage transistor is progressively shortened until a certain engine speed is reached and so that said duration remains approximately constant with increase of engine's speed above said certain engine speed.

4. An engine ignition system as defined in claim 1 in which said RC circuit branch is variable automatically in response to increase in temperature of said engine in such a way as to shorten progressively the portion of said discharge tail (S) that occurs before the termination of said period of nonconduction of said final stage transistor.

5. An engine ignition system as defined in claim 1 in which said RC circuit branch is so constituted that when said engine is starting the period of nonconduction of said final stage transistor (10) is sufficiently long to allow said discharge tail (S) following a main spark discharge (K) to subside before the termination of said period of nonconduction of said final stage transistor (10).

6. An engine ignition system including a final stage transistor having its emitter-collector path (10) connected, during engine operation, in series with a dc source and the primary winding of an ignition spark coil and arranged to be recurrently made nonconducting for periods long enough to produce, at a spark plug in the secondary circuit of said spark coil, a main spark discharge and an immediately following discharge tail, and including also an RC circuit branch (13) by which the duration of the period of nonconduction of said path of said transistor is determined, said system incorporating also the improvement consisting in that:

said RC circuit branch (13) consists of the series combination of a charging resistor (14), and a storage capacitor (15) so connected that the said nonconducting period of said path of said final stage transistor ends with the charging of said storage capacitor (15) and begins with the discharging of said storage capacitor (15);

the flow of current in at least one direction between the remainder of the system and said RC circuit branch, and thereby the rate of charging and/or discharging of said capacitor (15), is variable automatically in response to at least one operating parameter of the engine in such a manner that under certain operating conditions of the engine the duration of said period of nonconduction is terminated before the discharge tail (S) following a main spark discharge (A) has subsided;

a first control transistor (19) is provided and said RC circuit branch (13) has a first connection terminal (16) from which there branches a second circuit branch (18) that leads over the emitter-collector path of said first control transistor (19) to a first power supply terminal (3) connected during operation of said engine with one pole of said dc source (1), and said first terminal (16) of said RC circuit branch (13) is also the point from which branches a third branch circuit (21) that leads over at least one resistance (22) to a second power supply terminal (4) that is connected during operation of the engine to the other pole of said dc source (1), and a second control transistor (26) is provided and said RC circuit branch (13) has a second terminal (17) from which there branches a fourth circuit branch (23) that leads over a resistance (24) to said first power supply terminal (3) and there also branches, from said second terminal (17) of said RC circuit branch (13), a fifth circuit branch (25) that leads over the base-emitter path of said second control transistor (26) to said second power supply terminal (4).

7. An engine ignition system as defined in claim 6 in which said RD circuit branch is variable automatically in response to at least one operating parameter of the engine in such a manner that with increasing speed of the engine the portion of said discharge tail (S) following a main spark discharge (K) that occurs before the termination of the nonconducting period of said final stage transistor is progressively shortened until a certain engine speed is reached and so that duration remains approximately constant with increase of engine's speed above said certain engine speed.

8. An engine ignition system as defined in claim 6 in which said RC circuit branch is variable automatically in response to increase in temperature of said engine in such a way as to shortened progressively the portion of said discharge tail (S) that occurs before the termination of said period of nonconduction of said final stage transistor.

9. An engine ignition system as defined in claim 6 in which said RC circuit branch is so constituted that when said engine is starting the period of nonconduction of said final stage transistor (10) is sufficiently long to allow said discharge tail (S) following a main spark discharge (K) to subside before the termination of said period of nonconduction of said final stage transistor (10).

10. An engine ignition system as defined in claim 6 in which said second control transistor (26) has an emitter-connector path so connected in circuit that when it is in conducting condition, the said emitter-collector path of said final stage transistor (10) is likewise in conducting condition.

11. An engine ignition system as defined in claim 10 in which said first control transistor (19) and said second control transistor (26) are, with respect to each other, complementary types of transistors.

12. An engine ignition system as defined in claim 11 in which a feedback resistor (29) is connected between the base of said first control transistor (19) and the collector of said second control transistor (26).

13. An engine ignition system as defined in claim 11 in which a signal producing device (13) is provided that is driven by said engine and has an output connected to influence the base of said first control transistor (19).

14. An engine ignition system as defined in claim 11 in which the charging of said storage capacity (15) is produced over said second circuit branch and said fifth circuit branch (25), whereas the discharging of said storage capacity (15) is produced over said third circuit branch (21) and said fourth circuit branch (23).

15. An engine ignition system as defined in claim 14 in which said second circuit branch (18) includes a diode (43) having its cathode connected to said first terminal (16) of said RC circuit branch (13) and its anode connected through a voltage divider (44) to said second power supply terminal (4), and in which, further, a second diode (45) is provided having its anode connected to the tap (44*a*) of said voltage divider (44) and its cathode connected to the electrode of said storage capacitor (15) that is connected to said resistor (14) of said RC circuit branch (13), on the slide of said capacitor (15) nearer to said first terminal (16) of said RC circuit branch (13).

16. An engine ignition system as defined in claim 14 in which said resistance (22) in said third circuit branch (21) is subdivided into two resistors (22*a*), (22*b*) and the common connection (22*c*) of these two resistors (22*a*, 22*b*) is connected to the anode of a diode (46) of which the cathode is connected to the electrode of said storage capicator (15) that is connected to said resistance (14) of said RC circuit branch (13), which terminal of such capacitor (15) is the nearer terminal to said first terminal (16) of said RC circuit branch (13).

* * * * *

UNITED STATES PATENT AND TRADEMARK OFFICE

CERTIFICATE OF CORRECTION

PATENT NO. : 4,176,644

DATED : December 4, 1979

INVENTOR(S) : RAINER HELLBERG et al.

It is certified that error appears in the above-identified patent and that said Letters Patent are hereby corrected as shown below:

In column 9 of the patent:

Claim 7, line 2, "RD" should be --RC--.

Signed and Sealed this

*Twenty-fifth* Day of *March 1980*

[SEAL]

*Attest:*

SIDNEY A. DIAMOND

*Attesting Officer*

*Commissioner of Patents and Trademarks*